US005537697A

United States Patent [19]

Parker

[11] Patent Number: 5,537,697

[45] Date of Patent: Jul. 23, 1996

[54] BATH FOR USE BY ELDERLY OR DISABLED PERSONS

[75] Inventor: Roy Parker, Sway, Great Britain

[73] Assignee: Parker Bath Company, Limited, England

[21] Appl. No.: 506,135

[22] Filed: Jul. 24, 1995

Related U.S. Application Data

[63] Continuation of Ser. No. 221,493, Apr. 1, 1994, abandoned.

[30] Foreign Application Priority Data

Apr. 1, 1993 [GB] United Kingdom ..... 9306882

[51] Int. Cl.[6] ..... A47K 3/02

[52] U.S. Cl. ..... 4/563.1

[58] Field of Search ..... 4/561.1, 562.1, 4/563.1, 579, 560.1, 564.1, 565.1, 566.1, 589, 590

[56] References Cited

U.S. PATENT DOCUMENTS

| | | | |
|---|---|---|---|
| 3,714,672 | 2/1973 | Condon | 4/563.1 |
| 3,827,087 | 8/1974 | Cuthbertson . | |
| 3,879,770 | 4/1975 | Grant . | |
| 4,091,478 | 5/1978 | Hardwick et al. . | |
| 4,432,104 | 2/1984 | Sasaki | 4/560.1 X |
| 4,598,432 | 7/1986 | Pennington-Richards | 4/563.1 |
| 5,146,638 | 9/1992 | Richards | 4/565.1 X |

FOREIGN PATENT DOCUMENTS

| | | | |
|---|---|---|---|
| 1392005 | 1/1964 | France | 4/590 |
| 2332004 | 11/1976 | France . | |
| 0708717 | 5/1954 | United Kingdom | 4/590 |
| 2120933 | 12/1983 | United Kingdom . | |
| 2123285 | 2/1984 | United Kingdom . | |
| 2222767 | 3/1990 | United Kingdom . | |

*Primary Examiner*—Charles E. Phillips
*Attorney, Agent, or Firm*—Bacon & Thomas

[57] ABSTRACT

A bath for use by elderly or disabled persons, comprising a bath tub, and a seat for a user which seat is movable between a lower, bathing position and an upper position for the user to mount and dismount, wherein the seat is tiltable between a generally upright mode for use when in the upper position for mounting and dismounting and a reclined mode for use when in the lower position for bathing.

6 Claims, 1 Drawing Sheet

BATH FOR USE BY ELDERLY OR DISABLED PERSONS

Figure 1:
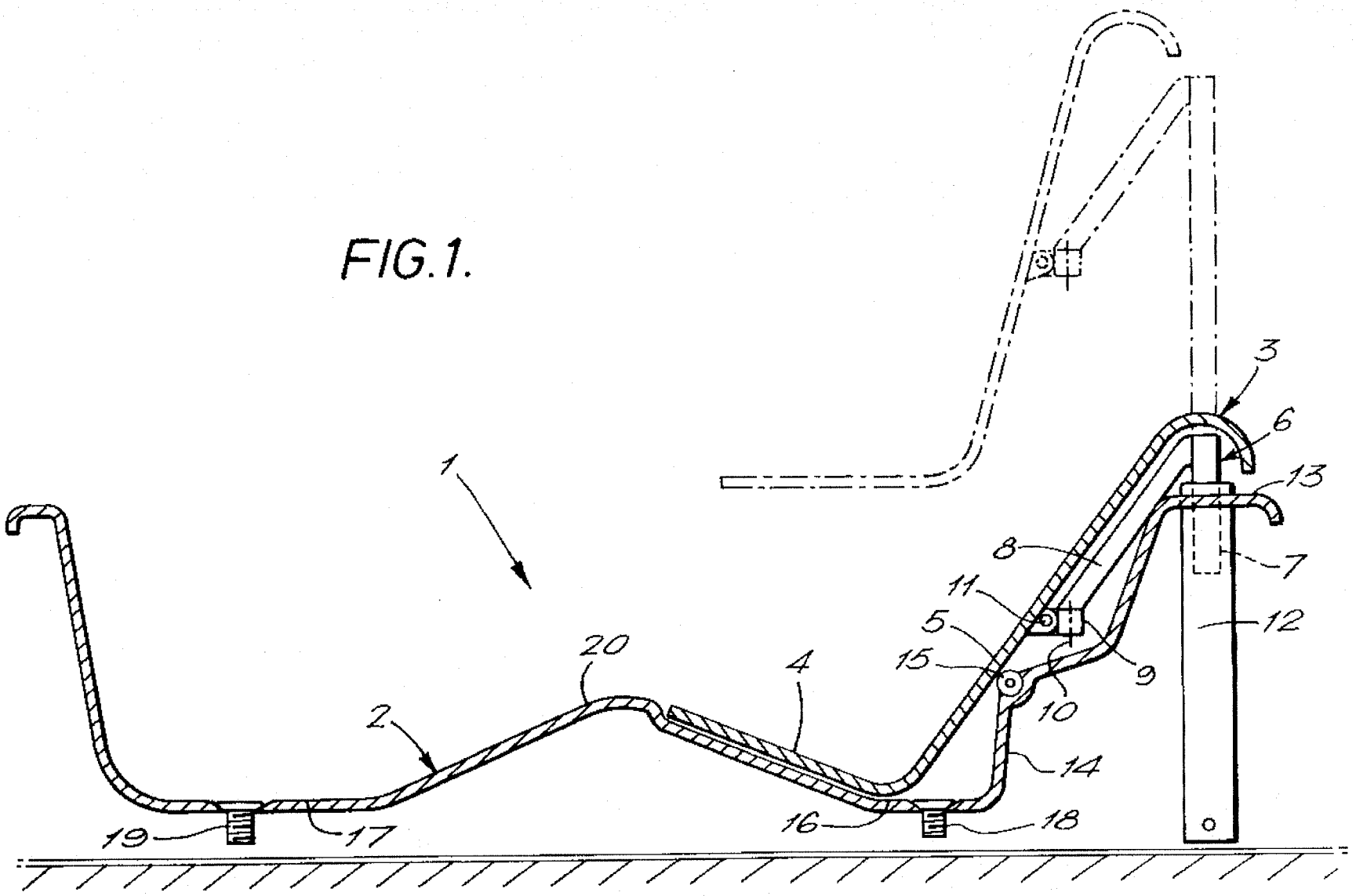

This application is a Continuation of application Ser. No. 08/221,493, filed Apr. 1, 1994, now abandoned.

This invention relates to baths.

It is known from British Patent No. 2222767 to provide a bath for disabled people provided at one end with a seat which is movable between a lower, bathing position within the bath tub and an upper position from which it is turnable sideways for the user to mount and dismount. With this bath the user sits generally upright on the seat so that only the lower half of the user's body is immersed in water when in the bathing position. In order to achieve greater immersion the user needs to slide forwardly on the seat but this is not always possible. Even if it is possible the user may not feel secure if he or she slides forward, in view of the difficulty of returning to the upright position.

According to the invention there is provided a bath for use by elderly or disabled persons, comprising a bath tub, and a seat for a user which seat is movable between a lower, bathing position and an upper position for the user to mount and dismount, wherein the seat is tiltable between a generally upright mode for use when in the upper position for mounting and dismounting and a reclined mode for use when in the lower position for bathing.

With such an arrangement the user can mount the seat when it is in the upright mode, but when bathing the user is reclined so as to achieve greater immersion than would be available if the seat remained in the upright mode. It is not necessary for the user to slide forwardly on the seat to achieve this immersion, thereby assisting the user to feel secure whilst bathing.

The seat may be arranged to move between the lower and upper positions at an angle to the vertical and may for example follow a curved path of movement to achieve tilting, e.g. using curved guide tracks. Preferably, however, the bath comprises substantially vertically movable support means on which the seat is arranged to tilt about a horizontal pivot axis.

The support means may for example include a substantially vertical shaft which may be driven electrically or by hydraulic or pneumatic pressure. The seat is preferably located at one end of an elongate bath, in which case the vertical shaft may be provided centrally of said one end or at one side thereof.

The horizontal pivot axis of the seat may be provided at the top of the support means, for example at the top of the vertical shaft. However, during tilting the bottom part of the seat moves generally upwardly and if the horizontal pivot axis is at the top, the bottom part lifts by a relatively large amount to achieve a given tilt angle. This lift means that some of the vertically downward movement of the support means is "lost" by the bottom part of the seat. Preferably therefore the vertically movable support means comprises a portion extending forwardly and downwardly into the bath, at least in the lower position of the seat, and the horizontal pivot axis is provided on said portion. By positioning the horizontal pivot axis in a lower position, the same tilt angle can be achieved with less lifting of the bottom part of the seat. Thus the vertical range of the support means need not be too large. Where a vertically movable shaft is provided, the horizontal pivot axis may then be located forwardly and downwardly of the top of the shaft. Whilst the horizontal pivot axis may be located adjacent to the bottom part of the seat, this may result in the seat having to be too far forward with a loss of some of the usable length of the bath.

Preferably therefore the horizontal pivot axis is positioned intermediate the top and the bottom of the seat, for example approximately halfway between the two.

A user may be able to mount and dismount the seat when in an upper position directly above the bath. Preferably, however, the seat is turnable sideways about a vertical pivot axis, so that it can be turned over e.g. the side rim of the bath in the upper position to facilitate mounting and dismounting. The vertical pivot axis may be provided at e.g. the end rim of the bath; for example, the seat may be turnable about the axis of the vertical shaft. However, in a preferred embodiment, the vertical pivot axis is provided on the forwardly and downwardly extending portion of the support means. If the bath is positioned in a room with the vertically movable support means near a wall of the room, the location of the vertical pivot axis in a relatively forward position provides more space for the seat to turn sideways without bumping against the wall.

The seat may have a part which covers the support means when the seat is in the reclined mode. This arrangement protects the support means against water splashes. The covering part may for example be the top portion of a back rest which may be arranged to curve over the top of the support means.

The bath may have a first drive means to move the seat between the lower and upper positions and a second, separate drive means to effect tilting of the seat. Preferably the bath comprises engaging means engageable by the seat during downward movement thereof to cause the seat to tilt to the reclined mode during such downward movement. The engaging means may for example be a fixed portion of the bath tub engageable by the seat or by a rotatable member on the seat. Preferably the engaging means comprises at least one rotatable member, such as a wheel, roller or the like. This can for example be engageable by the back surface of the seat back rest during downward movement of the seat.

In a preferred form of the invention, the bath tub has a seat well into which the seat is lowered and a foot well. Thus the region between the two wells, where the user's knees will normally be positioned when the seat is in the reclined mode, will not need a large quantity of water. In order to achieve good drainage of the bath, the seat well and the foot well preferably each have a drain.

A preferred embodiment of the invention will now be described by way of example and with reference to the accompanying drawing, in which FIG. 1 is a longitudinal cross-section through a bath.

The bath 1 consists of a bath tub 2 and a seat 3 having a bottom part 4 and a back rest 5. The seat includes at least one drainage hole (not shown), which may for example be located at the junction between the bottom part and the back rest. The seat 3 is supported by vertically movable support means 6 consisting of a hydraulically driven vertical shaft 7 and an arm 8 which extends forwardly and downwardly from the top of the shaft. At the end of the arm 8 a bracket 9 is mounted to turn about a vertical pivot axis 10. The seat 3 is supported on the bracket 9 to be pivotable about a horizontal axis 11. The vertically movable shaft 7 is arranged to be driven by a hydraulic drive unit 12 which passes upwardly through the rim 13 of the bath tub 2 at the rear end thereof.

A rear end wall 14 of the bath tub 2 is provided with a wheel 15 which is engageable with the seat back rest 5 along a rear surface thereof below the horizontal pivot axis 11. The bath tub 2 has a seat well 16 with a drain 18 and a foot well 17 with a drain 19. The bath tub has an elevated portion 20 between the two wells.

The operation of the bath will now be described. FIG. 1 shows in dotted lines the seat 3 in an upper position and in full lines the seat in the lower position. In the upper position the seat is generally upright and can be turned sideways about the vertical pivot axis 10 to assist the user in mounting and dismounting the seat. The weight of a user on the seat bottom part 4 tends to maintain the seat in the upright mode. The hydraulic drive unit 12 is operable to lower the seat 3 to its lower position. During lowering, the seat initially remains in the upright position but eventually the rear surface of the seat back rest 5 engages the wheel 15 so that continued downward movement of the seat causes the seat to tilt rearwardly from the upright mode to the reclined mode. When the seat is fully lowered it adopts the position shown in FIG. 1 in the reclined mode. This reclines the user and achieves greater immersion than would be the case without tilting. The bottom part 4 of the seat is inclined downwardly towards the back rest 5 such that the user is reclined for bathing. When the hydraulic drive unit is operated to lift the seat, it automatically tilts back to the upright mode under the control of the wheel 15 engaging the rear surface of the back rest 5.

It will be appreciated that the terms "upright mode" and "reclined mode" as used in this specification are intended to be understood relative to each other. Thus in the reclined mode, the seat is simply more reclined than in the upright mode. When the seat is stated as being in the upright mode, this does not mean that any part thereof, e.g. the back rest, is necessarily vertically upright.

I claim:

1. A bath for use by elderly or disabled persons, comprising a bathtub having an inclined end wall and a bottom; a seat for a bather having a seat part and a rearward back part fixedly secured thereto; means adjacent said tub end wall for mounting and moving the seat between raised and lowered positions relative to the tub end wall and tub bottom, and for enabling the seat to pivot about a horizontal axis relative to the tub end wall and tub bottom so that the seat may be inclined to a backward inclined position relative to the seat raised position whereat the seat part is inclined downwardly and rearwardly relative to its raised position; said means for mounting and moving the seat comprising a substantially vertical movable support means and a pivot connection pivotally connecting the seat to the support means for tilting about a horizontal pivot axis; said substantially vertical support means comprising a support portion extending forwardly and downwardly towards the interior of the bathtub generally above said end wall, and wherein the pivot connection is provided on said portion, wherein said substantially vertically movable support means includes an uppermost end; and wherein the pivot connection is positioned intermediate said uppermost end of the substantially vertically moveable support means and the bottom part of the seat; and means for causing engagement between the seat back part and the tub end wall to cause said pivoting of said seat about said horizontal axis to said backward inclined position relative to the seat raised position during lowering of the seat by said means for mounting and moving the seat, said seat back normally being disengaged from the tub end wall when the seat is in the raised position.

2. A bath for use by elderly or disabled persons, comprising a bathtub having an inclined end wall and a bottom; a seat for a bather having a seat part and a rearward back part fixedly secured thereto; means adjacent said tub end wall for mounting and moving the seat between raised and lowered positions relative to the tub end wall and tub bottom, and for enabling the seat to pivot about a horizontal axis relative to the tub end wall and tub bottom so that the seat may be inclined to a backward inclined position relative to the seat raised position whereat the seat part is inclined downwardly and rearwardly relative to its raised position; said means for mounting and moving the seat comprising a substantially vertical movable support means and a pivot connection pivotally connecting the seat to the support means for tilting about a horizontal pivot axis; said substantially vertical support means comprising a support portion extending forwardly and downwardly towards the interior of the bathtub generally above said end wall, and wherein the pivot connection is provided on said portion; means for enabling the seat to pivot about a vertical pivot axis at least when the seat is in the raised position; said means for enabling the seat to pivot about a vertical pivot axis including a pivot connection between the seat and said support portion; and means for causing engagement between the seat back part and the tub end wall to cause said pivoting of said seat about said horizontal axis to said backward inclined position relative to the seat raised position during lowering of the seat by said means for mounting and moving the seat, said seat back normally being disengaged from the tub end wall when the seat is in the raised position.

3. A bath for use by elderly or disabled persons, comprising a bathtub having an inclined end wall and a bottom; a seat for a bather having a seat part and a rearward back part fixedly secured thereto; means adjacent said tub end wall for mounting and moving the seat between raised and lowered positions relative to the tub end wall and tub bottom, and for enabling the seat to pivot about a horizontal axis relative to the tub end wall and tub bottom so that the seat may be inclined to a backward inclined position relative to the seat raised position whereat the seat part is inclined downwardly and rearwardly relative to its raised position; said means for mounting and moving the seat comprising a substantially vertical movable support means and a pivot connection pivotally connecting the seat to the support means for tilting about a horizontal pivot axis; said substantially vertical support means comprising a support portion extending forwardly and downwardly towards the interior of the bathtub generally above said end wall, and wherein the pivot connection is provided on said portion; means for enabling the seat to pivot about a vertical pivot axis at least when the seat is in the raised position; said substantially vertically movable support means comprising a substantially vertical shaft having a longitudinal axis, and said means for enabling the seat to pivot about a vertical pivot axis comprises means for enabling the seat to pivot about the longitudinal axis of said shaft; means for causing engagement between the seat back part and the tub end wall to cause said pivoting of said seat about said horizontal axis to said backward inclined position relative to the seat raised position during lowering of the seat by said means for mounting and moving the seat, said seat back normally being disengaged from the tub end wall when the seat is in the raised position.

4. A bath for use by elderly or disabled persons, comprising a bathtub having an inclined end wall and a bottom; a seat for a bather having a seat part and a rearward back part fixedly secured thereto; means adjacent said tub end wall for mounting and moving the seat between raised and lowered positions relative to the tub end wall and tub bottom, and for enabling the seat to pivot about a horizontal axis relative to the tub end wall and tub bottom so that the seat may be inclined to a backward inclined position relative to the seat raised position whereat the seat part is inclined downwardly and rearwardly relative to its raised position; said means for mounting and moving the seat comprising a substantially vertical movable support means and a pivot connection pivotally connecting the seat to the support means for tilting about a horizontal pivot axis; means connected to the seat for covering the support means at least when the seat is in the lower position; and means for causing engagement between the seat back part and the tub end wall to cause said pivoting of said seat about said horizontal axis to said backward inclined position relative to the seat raised position during lowering of the seat by said means for mounting and moving the seat, said seat back normally being disengaged from the tub end wall when the seat is in the raised position.

5. A bath for use by elderly or disabled persons, comprising a bathtub having an inclined end wall and a bottom; a seat for a bather having a seat part and a rearward back part fixedly secured thereto; means adjacent said tub end wall for mounting and moving the seat between raised and lowered positions relative to the tub end wall and tub bottom, and for enabling the seat to pivot about a horizontal axis relative to the tub end wall and tub bottom so that the seat may be inclined to a backward inclined position relative to the seat raised position whereat the seat part is inclined downwardly and rearwardly relative to its raised position; means for causing engagement between the seat back part and the tub end wall to cause said pivoting of said seat about said horizontal axis to said backward inclined position relative to the seat raised position during lowering of the seat by said means for mounting and moving the seat, said seat back normally being disengaged from the tub end wall when the seat is in the raised position; said bathtub having a seat well at one end adjacent said end wall into which the seat is lowered and a footwell, said seat well including a surface inclined rearwardly and downwardly towards said end wall, said seat bottom part in its lowered position extending parallel to said seat well inclined surface.

6. A bath as claimed in claim 5, wherein the seat well and the foot well each have a drain.

* * * * *